US006565663B2

(12) United States Patent
Mizia et al.

(10) Patent No.: US 6,565,663 B2
(45) Date of Patent: May 20, 2003

(54) USE OF ORGANIC CARBONATES AS SOLVENTS FOR THE WASHING OF METAL SURFACES

(75) Inventors: Franco Mizia, San Donato Milanese (IT); Franco Rivetti, Milan (IT)

(73) Assignee: Enichem S.p.A., San Donato Milanese (IT)

( * ) Notice: Subject to any disclaimer, the term of this patent is extended or adjusted under 35 U.S.C. 154(b) by 0 days.

(21) Appl. No.: 10/029,813

(22) Filed: Dec. 31, 2001

(65) Prior Publication Data

US 2002/0056468 A1 May 16, 2002

Related U.S. Application Data

(62) Division of application No. 09/657,903, filed on Sep. 8, 2000, now abandoned.

(30) Foreign Application Priority Data

Sep. 9, 1999 (IT) ..... MI99A1889

(51) Int. Cl.[7] ..... B08B 3/02

(52) U.S. Cl. ..... 134/2; 134/1; 134/22.1; 134/22.11; 134/22.12; 134/22.14; 134/22.18; 134/22.19; 134/34; 134/35; 134/36; 134/42

(58) Field of Search ..... 134/1, 2, 22.1, 134/22.11, 22.12, 22.14, 22.18, 22.19, 34, 35, 36, 42

(56) References Cited

U.S. PATENT DOCUMENTS

| | | | | |
|---|---|---|---|---|
| 4,680,133 A | | 7/1987 | Ward | 252/153 |
| 5,204,026 A | | 4/1993 | Doscher-Good | 252/542 |
| 5,346,615 A | * | 9/1994 | Savastano | 208/309 |
| 5,514,221 A | | 5/1996 | Bolmer | 134/40 |
| 5,633,099 A | | 5/1997 | Yokoyama et al. | 429/194 |
| 5,853,490 A | * | 12/1998 | Dunn et al. | 134/2 |
| 6,063,749 A | | 5/2000 | DeGroot | 510/412 |
| 6,159,915 A | | 12/2000 | Machac, Jr. et al. | 510/201 |
| 6,169,061 B1 | | 1/2001 | Machac, Jr. et al. | 510/201 |
| 6,200,352 B1 | | 3/2001 | Romack et al. | 8/142 |

FOREIGN PATENT DOCUMENTS

| | | | |
|---|---|---|---|
| JP | 09-078095 | | 3/1997 |
| WO | WO99/02642 | * | 1/1999 |
| WO | WO 99/57217 | | 11/1999 |

* cited by examiner

*Primary Examiner*—Sharidan Carrillo
(74) *Attorney, Agent, or Firm*—Oblon, Spivak, McClelland, Maier & Neustadt, P.C.

(57) ABSTRACT

The invention relates to the use of organic carbonates having formula (I)

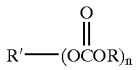

wherein:

n=1–4

R and R' are two linear or branched alkyl radicals which contain a number of carbon atoms whose sum is equal to at least 5 and which can be the same or different, as solvents for the washing of metal surfaces.

8 Claims, No Drawings

USE OF ORGANIC CARBONATES AS SOLVENTS FOR THE WASHING OF METAL SURFACES

This application is a Division of application Ser. No. 09/657,903 filed on Sep. 8, 2000, now abandoned.

BACKGROUND OF THE INVENTION

Description of the Background

As is known, the processing of metals (cutting, polishing, forming) as also processing in the oil drilling field, require the use of auxiliary fluids which generally consist of a mineral or synthetic oil as such or emulsified, optionally charged with solids (pastes, mud).

The residues of the processing fluid must be removed at the end of the processing, before passing to a subsequent phase where their presence would prevent its feasibility.

In the mechanical industry, for the washing of finished or semi-finished metal products contaminated by oils, emulsions and polishing pastes, non-flammable solvents are used, such as for example chlorinated products, which are toxic for the persons using them and also particularly harmful for the environment owing to the poor biodegrad-ability and their high ozone consumption potential (ODP) (B. P. Whim, B. G. Johnson "Directory of solvents" page 173, 1997).

In the oil drilling field, steel pipes (casings) which are lowered into the well in the presence of oil mud must be washed before passing to the cementing phase.

In this case the washing of the mud-contaminated surfaces with solvents is at present carried out using solvents which are volatile, toxic, flammable, non-biodegradable and with a high content of aromatics such as carbon-naphtha, for example.

As far as the safety of the work-site and workers who are exposed to these solvents, is concerned, the competent authorities are issuing increasingly strict regulations and criteria for the production and use of solvents, but it is evident that the use of effective solvents which are non-flammable, atoxic, eco-compatible (biodegradable with a low ODP) and with a low volatility, not only provides a real solution to problems relating to personnel safety and respect for the environment, but also presents greater simplicity in the use, conservation and disposal of these solvents, which is reflected in the operating costs.

In accordance with this, great necessity is felt in the solvent field for the use of solvents which satisfy the above requisites at acceptable costs for application on an industrial scale. The chemical industry is therefore making considerable efforts to supply adequate solvents, as an alternative to the traditional ones.

SUMMARY OF THE INVENTION

It has now been found that organic carbonates can be effectively used as solvents for the washing in an open system of metal surfaces contaminated by fluids such as mineral oils, synthetic oils or their emulsions o/w optionally charged with solids, in order to obtain auxiliary fluids in the form of pastes or mud.

The present invention therefore relates to the use of organic carbonates as solvents for the washing of metal surfaces.

The invention also relates to a process for the washing of metal surfaces which consists in applying the solvent based on organic carbonates to metal surfaces and under suitable conditions for removing the contaminants present from the surfaces.

DETAILED DESCRIPTION OF THE INVENTION

In particular, the organic carbonates described in the invention are represented by the following formula:

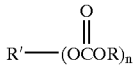

wherein:

n=1–4

R and R' are two linear or branched alkyl radicals which contain a number of carbon atoms whose sum is equal to at least 5 and which can be the same or different.

Examples of carbonates which can be used for the invention are: methyl n-butyl carbonate, methyl n-pentyl carbonate, methyl iso-octyl carbonate, di-isopropyl carbonate, di-n-propyl carbonate, di-n-butyl carbonate, di-iso-propyl carbonate, di-iso-octyl carbonate.

The general characteristics of the di-alkyl carbonates object of the invention are: low solubility in water which is always less than 1,000 ppm and therefore also an excellent hydrolytic stability, Kauri-Butanol index equal to at least 150, flash point higher than 55° C., boiling point higher than 145° C. at atmospheric pressure.

The advantages obtained from using organic carbonates in this type of application are: effectiveness in removing contaminants, simplification of the equipment which uses them i.e. being able to operate in an open system as the emissions produced, owing to their characteristics (biodegradability, low ODP and atoxic) and their reduced quantity, do not create any problems either for human beings or for the environment.

In accordance with this, they can therefore also be used in offshore drilling activities, such as for example, in the washing of casings where, in practice, a substantial hydrolytic stability of the solvent and in any case the non-toxicity of its degradation products are also required.

Corrosion inhibitors, non-ionic wetting agents and water for their application in emulsion, can optionally be added to the organic carbonates, object of the invention.

The solvents, object of the invention, are based on di-alkyl carbonates.

If these are produced by the trans-esterification of dimethylcarbonate (DMC) with higher alcohols, they are without halogens and free acidity deriving therefrom.

The alcohols which can be used for producing the di-alkyl carbonates object of the invention, have $C_3$–$C_{25}$ chains.

A criterion however, for selecting the alcohol, to ensure absolute compatibility of the di-alkyl carbonate deriving therefrom, also in the presence of traces of residual free synthesis alcohol and/or deriving from the degradation of the ester during use, is provided by the toxicological and eco-toxicological characteristics deriving from the structure of the alcohol itself.

Symmetrical or asymmetrical carbonates can be obtained when mixtures of at least two alcohols are fed to the trans-esterification.

In a preferred embodiment, the di-alkyl carbonate can be di-n-butyl carbonate (DnBC) or di-iso-octyl carbonate (DiOC) or their mixtures.

The solvent, object of the present invention, is preferably used pure as such, or is formulated to be subsequently applied in aqueous emulsion.

The formulate may optionally contain a corrosion inhibitor, a co-solvent and an emulsifying agent; it is generally preferable in the preparation of the formulate for the weight fraction of each of the additives not to exceed 20% w of the formulate.

The corrosion inhibitor can be selected from the group of amino-alcohols having tertiary nitrogen, such as for example, tri-ethanol (TEA).

The co-solvent can be selected from the group of glycol ethers; examples of co-solvent comprise propylene glycol methylether (PM), di-propylene glycol methylether (DPM) or di-propylene glycol n-butyl ether (DPNB).

The emulsifying agent can be selected from the group of non-ionic surface active agents, from the group of ethoxylated alcohols or acids, preferably using those of the $C_9$–$C_{18}$ aliphatic series which optimize the hydrophilic/lipophilic (HLB) ratio which characterizes them.

The conditions under which the washing of metal surfaces, object of the present invention, is carried out, can vary.

The washing is generally carried out at atmospheric pressure within a temperature range of 20° C. to a maximum which is close to, but without exceeding, the flash point of the di-alkyl carbonate used.

The means of applying the solvent to the item to be washed, are not critical; in most cases simple immersion in a tank which does not necessarily have to be thermostat-regulated, is sufficient.

Mechanical actions such as manual application or spraying or also the use of ultra-sounds reduce the time required for the washing.

It should be noted however that the contact time required by the solvent also depends on a series of factors, such as the type of oil/grease to be removed, the formulation which contains it and the aging of the contaminant especially if in paste or mud form.

The contact times generally range from less than a minute to an hour; longer contact times however can be adopted without there being any risk of ruining the surface to be treated.

The following examples are illustrative and do not limit the scope of the invention in any way.

EXAMPLE 1

Di-normal butyl carbonate (DnBC) was used with a purity of over 99% w for the washing at 40° C. of the surface of metal test-samples contaminated by residues/crusts of the drilling auxiliary consisting of an inverse emulsion mud containing barite prepared using a mineral oil with a very low content of aromatic hydrocarbons.

The filtrate reducer and wetting agent were dosed in excess with respect to the standard, to provide a tighter adhesion of the mud onto the steel.

The mud thus prepared was characterized by an oil/water ratio equal to 90/10, a density of 2.1 Kg/lt, plastic viscosity (PV) of 54 cP, yield point (YP) of 14.5 gr/100 $cm^2$.

The washing was effected by simple static immersion of the test-samples in the solvent.

Under these conditions, the complete removal of the contaminant from the metal surface of the test samples was obtained in 20 minutes.

EXAMPLE 2

The washing of metal test-samples carried out according to the procedure described in example 1 was effected using DnBC at 60° C. The complete removal of the contaminant from the surface was obtained in 8 minutes.

EXAMPLE 3

Di-normal butyl carbonate (DnBC) was used with a purity of over 99% w for the washing at 40° C. of the surface of metal test-samples contaminated by residues/crusts of the drilling auxiliary consisting of an inverse emulsion mud containing barite prepared using gas oil.

The mud thus prepared was characterized by an oil/brine ratio equal to 75/25, a density of 1.47 Kg/lt, plastic viscosity (PV) of 23 cP, yield point (YP) of 2 gr/100 $cm^2$.

The washing was effected by simple static immersion of the test-samples in the solvent.

Under these conditions, the complete removal of the contaminant from the metal surface of the test samples was obtained in 3 minutes.

EXAMPLE 4

Di-normal butyl carbonate (DnBC) was used with a purity of over 99% w for the washing at 40° C. of the surface of metal test-samples contaminated by residues/crusts of the drilling auxiliary consisting of an inverse emulsion mud containing barite prepared using a mineral oil with a low content of AF aromatics.

The mud thus prepared was characterized by an oil/brine ratio equal to 75/25, a density of 1.47 Kg/lt, a PV of 23 cP, a YP of 2 gr/100 $cm^2$.

The washing was effected by simple static immersion of the test-samples in the solvent.

Under these conditions, the complete removal of the contaminant from the metal surface of the test samples was obtained in 3 minutes.

EXAMPLE 5

Di-normal butyl carbonate (DnBC) was used with a purity of over 99% w for the washing at 40° C. of the surface of the rotor (metal cylinder having a diameter of about 3 cm and a height of about 8 cm) of a FANN 35 rotating viscometer. The test procedure included contamination of the rotor by immerging and rotating it for 5 minutes at 600 rpm in an inverse emulsion mud containing barite, prepared using a mineral oil with a low content of AF aromatics and characterized by an oil/water ratio equal to 90/10, a density of 1.9 Kg/lt.

The mud which had not adhered to the rotor was left to drip for 2 minutes and the rotor was then washed by immersion and rotation at 200 rpm in the thermostat-heated solvent.

Under these conditions, the complete removal of the contaminant from the metal surface of the cylinder was obtained in 8 minutes.

EXAMPLE 6

The washing of the metal rotor, carried out according to the procedure described in example 5, was effected using DNBC at 60° C.

The complete removal of the contaminant from the surface of the rotor was obtained in 5 minutes.

EXAMPLE 7

For the washing of coarse frames for glasses made of Cu/Ni/Fe monel (DIN 17143) alloy and Cu/Ni/Zn alpaca (DIN 17663) alloy, coming from the polishing phase and contaminated by mineral oil mixed with coconut granulate, W powder, the following formulate was used:

DBC 40% w
Di-propylene glycol mono methyl ether (DPM) 30% w
Tri-ethanol amine (TEA) 10% w
Mixture of $C_{12}/C_{15}$ alcohols ethoxylated with 7 moles of ETO: 20%

About 4 liters of formulate were diluted with 36 lt of water and poured into a tank thermostat-regulated at 70° C. where the frames, placed in baskets, were immersed in the liquid under continuous rocking.

Ultra-sounds were applied to the liquid with an overall power of 800 Watts.

The complete removal of the contaminants was obtained in 15 minutes of treatment.

EXAMPLE 8

For the washing of decorative items contaminated by polishing pastes (necklaces and brooches) made of Silver plating, the formulate was used under the conditions described in Example 7. The complete removal of the contaminants was obtained in 20 minutes of treatment.

EXAMPLE 9

For the washing of brass buckles contaminated by polishing pastes, di-normal butyl carbonate (DnBC) was used with a purity of over 99% w. The buckles (several tens) were placed in baskets which were immersed in a tank containing about 40 liters of liquid and were kept there in a static position.

Ultra-sounds were applied to the liquid, thermostat-regulated at 40° C., with an overall power of 800 Watts.

The complete removal of the contaminants was obtained in 10 minutes of treatment.

EXAMPLE 10

Comparative with 1

The washing of metal test-samples carried out according to the procedure described in example 1, was effected using a conventional solvent (carbon-naphtha) consisting of aromatic hydrocarbons. The complete removal of the contaminants from the metal surface of the test-samples was obtained in 15 minutes.

EXAMPLE 11

Comparative with 4

The washing of metal test-samples carried out according to the procedure described in example 4, was effected using a conventional solvent (carbon-naphtha) consisting of aromatic hydrocarbons. The complete removal of the contaminants from the metal surface of the test-samples was obtained in 5 minutes.

EXAMPLE 12

Comparative with 6

The washing of metal test-samples carried out according to the procedure described in example 6, was effected using a conventional solvent consisting of aromatic hydrocarbons and terpene derivatives. The complete removal of the contaminants from the metal surface of the test-samples was obtained in 2 minutes.

What is claimed is:

1. A process for the washing of metal surfaces which comprises applying a composition comprising at least 40% by weight of, as a solvent, an organic carbonate having formula (I)

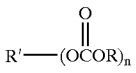

wherein:

n=1–4

R and R' are two linear or branched alkyl radicals which contain a number of carbon atoms whose sum is equal to at least 5 and which can be the same or different, onto a metal surface contaminated by fluids, optionally charged with solids, either manually or by spraying or by immersion in a tank, wherein said applying is at atmospheric pressure, at a temperature ranging from 20° C. up to the flash point of the organic carbonate, wherein the composition additionally contains additives comprising corrosion inhibitors, non-ionic wetting agents and water, which composition is applied as an aqueous emulsion.

2. The process according to claim 1, wherein the organic carbonate is selected from the group consisting of methyl n-butyl carbonate, methyl n-pentyl carbonate, methyl iso-octyl carbonate, di-isopropyl carbonate, di-n-propyl carbonate, di-n-butyl carbonate, di-isopropyl carbonate, di-iso-octyl carbonate and their mixtures.

3. The process according to claim 1, wherein the weight fraction of each of the additives does not exceed 20% w of the aqueous emulsion.

4. The process according to claim 1, wherein the washing in a tank is carried out by means of ultra-sounds.

5. The process according to claim 1, wherein the fluids are mineral oils, synthetic oils or their emulsions, each optionally charged with solids.

6. The process according to claim 1, wherein the organic carbonate is di-normal butyl carbonate.

7. A process for the washing of metal surfaces which comprises applying a composition consisting of, with a purity of over 99% by weight, as a solvent, an organic carbonate having formula (I)

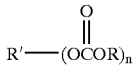

wherein:

n=1–4

R and R' are two linear or branched alkyl radicals which contain a number of carbon atoms whose sum is equal to at least 5 and which can be the same or different, onto a metal surface contaminated by fluids, optionally charged with solids, either manually or by spraying or by immersion in a tank wherein said applying is, at atmospheric pressure, at a temperature ranging from 20° C. up to the flash point of the organic carbonate.

8. A process for the washing of metal surfaces which comprises applying a composition comprising at least 40% by weight of, as a solvent, an organic carbonate having formula (I)

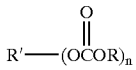

wherein:

n=1–4

R and R' are two linear or branched alkyl radicals which contain a number of carbon atoms whose sum is equal to at least 5 and which can be the same or different, onto a metal surface contaminated by fluids, optionally charged with solids, either manually or by spraying or by immersion in a tank, wherein said applying is at atmospheric pressure, at a temperature ranging from 20° C. up to the flash point of the organic carbonate, wherein the composition comprising, by weight, 40% of said organic carbonate, and additionally comprises 30% of di-propylene glycol monomethyl ether, 10% of tri-ethanol amine, and 20% of a mixture of $C_{12}$–$C_{15}$ alcohols ethoxylated with seven moles of ethylene oxide.

* * * * *